US006158959A

United States Patent [19]

Arbeus

[11] Patent Number: 6,158,959

[45] Date of Patent: Dec. 12, 2000

[54] PUMP IMPELLER

[75] Inventor: Ulf Arbeus, Lidingo, Sweden

[73] Assignee: ITT Manufacturing Enterprises, Inc., Wilmington, Del.

[21] Appl. No.: 09/095,204

[22] Filed: Jun. 10, 1998

[30] Foreign Application Priority Data

Nov. 18, 1997 [SE] Sweden ..... 9704223

[51] Int. Cl.[7] ..... F04D 7/02; F04D 39/42

[52] U.S. Cl. ..... 415/204; 415/206; 415/72; 416/177

[58] Field of Search ..... 415/204, 206, 415/72; 416/176, 177, 183, 185, 223 R, 223 B, 238

[56] References Cited

U.S. PATENT DOCUMENTS

| | | | |
|---|---|---|---|
| 3,644,056 | 2/1972 | Wiselius | 415/215 |
| 4,540,334 | 9/1985 | Stahle | 415/72 |
| 4,594,052 | 6/1986 | Niskanen | 415/121 B |

*Primary Examiner*—Edward K. Look
*Assistant Examiner*—Rhonda Barton
*Attorney, Agent, or Firm*—M. J. Lombardi

[57] ABSTRACT

A pump impeller of a centrifugal or a half axial type meant to pump liquids, mainly sewage water. The pump impeller has a hub (4) provided with one or several vanes (5) the leading edges (6) of which being strongly swept backwards. The periphery (8) of the leading edge is displaced 125–195 degrees relative to its connection (7) to the hub (4).

6 Claims, 2 Drawing Sheets

PUMP IMPELLER

FIELD OF THE INVENTION

This invention concerns a pump impeller and more precisely a pump impeller for centrifugal or half axial pumps for pumping of fluids, mainly sewage water.

BACKGROUND OF THE INVENTION

In the literature there are lot of types of pumps and pump impellers for pumping fluids such as sewage water. However, all of these pumps have certain disadvantages relating to clogging and low efficiency.

Sewage water contains a lot of different types of pollutants, the amount and structure of which depend on the season and type of area from which the water emanates. In cities, plastic material, hygiene articles, textile etc are commonly found in the sewage water. Industrial areas produce sewage water with wearing particles. Experience shows that the worst problems are rags and the like which stick to the leading edges of the vanes and become wound around the impeller hub. Such incidents cause frequent service intervals and a reduced efficiency.

In agriculture and pulp industries, different kinds of special pumps are used to manage straw, grass, leaves and other types of organic material. For this purpose the leading edges of the vanes are swept backwards in order to cause the pollutants to be fed outwards to the periphery instead of getting stuck to the edges. Different types of disintegration means are often used for cutting the material and making the flow more easy. Examples are shown in Swedish patents SE-435 952, SE-375 831 and U.S. Pat. No. 4,347,035.

As pollutants in sewage water are of other types and thus, more difficult to master, and as the operation times for sewage water pumps are normally much longer, the above mentioned special pumps do not fulfill reliability or efficiency requirements when pumping sewage water.

A sewage water pump quite often operates up to 12 hours a day which means that the energy consumption depends a lot on the total efficiency of the pump.

Tests have proven that it is possible to improve efficiency by up to 50% for a sewage pump according to the invention as compared with known sewage pumps. As the life cycle cost for an electrically driven pump normally is totally dominated by energy costs (c:a 80%), thus it is evident that such a dramatic increase will be extremely important.

The designs of pump impellers are described very generally in the literature, especially in regard to the sweep of the leading edges. An unambiguous definition of sweep does not exist.

Tests have shown that the design of the sweep angle distribution on the leading edges is very important in order to obtain the necessary self cleaning ability of the pump impeller. The nature of the pollutants also calls for different sweep angles in order to provide a good function.

The literature does not give any information about what is needed in order to obtain a gliding transport of pollutants outwards in a radial direction along the leading edges of the vanes. Generally what is mentioned is that the edges of the vanes shall be obtuse-angled, swept backwards, etc. See Swedish patent SE-435 952.

When smaller pollutants such as grass and other organic material are pumped, relatively small angles may be sufficient in order to obtain radial transport and also disintegrate the pollutants in the slot between pump impeller and the surrounding housing. In practice, disintegration is obtained by the particles being cut through contact with the impeller and the housing when the former rotates with a periphery velocity of 10 to 25 m/s. This cutting process is improved by the surfaces being provided with cutting devices, slots or the like. Compare Swedish patent SE-435 952. Such pumps are used for transport of pulp, manure etc.

When designing a pump impeller having vane leading edges swept backwards in order to obtain self cleaning, a conflict arises between the distribution of the sweep angle, performance and other design parameters. In general, it is true that an increased sweep angle means less risk for clogging, but at the same time efficiency decreases.

BRIEF DESCRIPTION OF THE DRAWINGS

The invention is described more closely below with reference to the enclosed drawings.

DETAILED DESCRIPTION OF THE DRAWINGS

Figure 1:
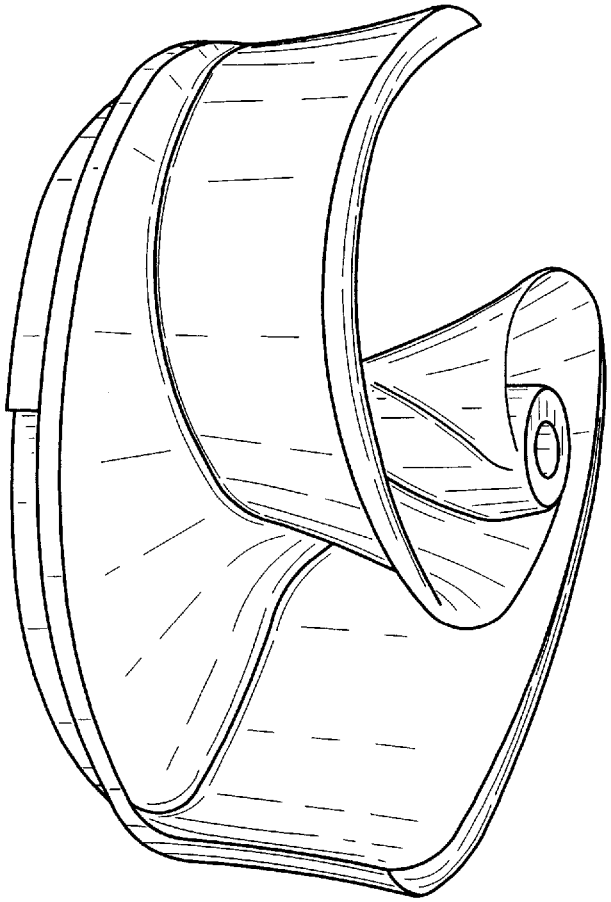
FIG. 1 is a three dimensional view of a pump impeller according to the invention.
Figure 2:
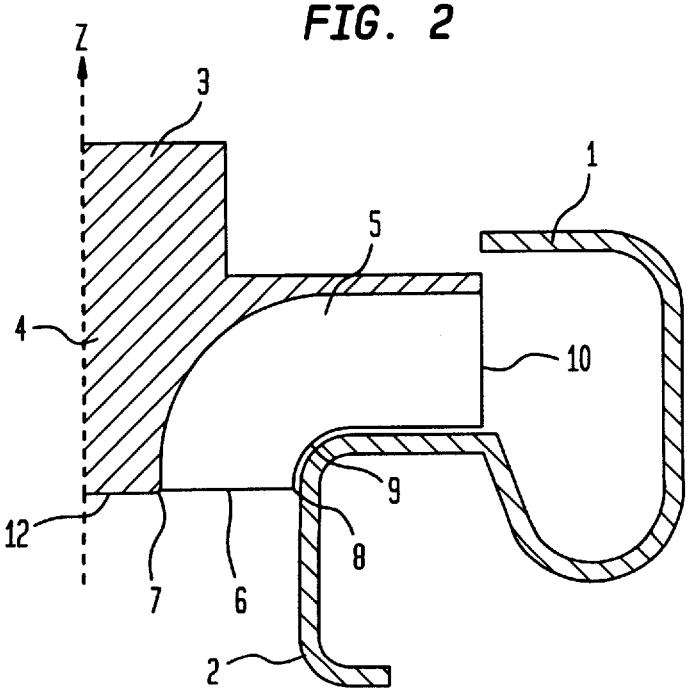
FIG. 2 is a radial cut through a schematically drawn pump according to the invention.
Figure 3:
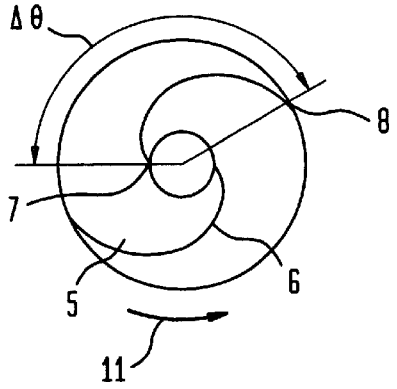
FIG. 3 is a schematic axial view of the inlet to the impeller.
Figure 4:
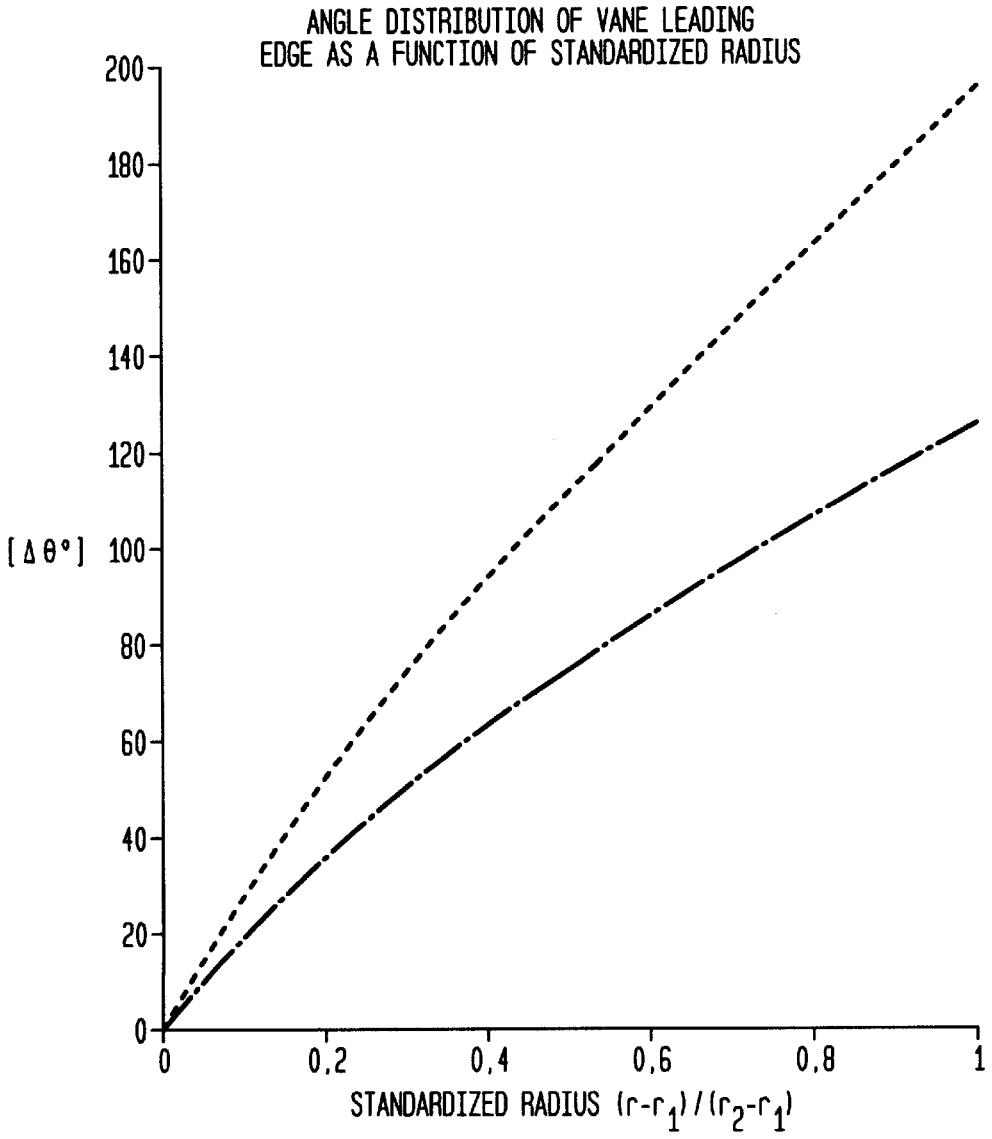
FIG. 4 is a diagram showing the angle distribution of the vane leading edge as a function of a standardized radius.

In the drawings the numeral 1 identifies a centrifugal pump housing having a cylindric inlet 2. The reference numeral 3 identifies a pump impeller with a cylindric hub 4 and a vane 5. Reference numeral 6 identifies the leading edge of the vane 5 having a connection 7 to the hub 4 and a periphery 8. The reference numeral 9 identifies the slot between the vane 5 and the pump housing wall and the reference numeral 10 identifies the trailing edge of the vane. The reference numeral 11 identifies the direction of rotation and the reference numeral 12 identifies the end of the hub. The symbols $\Delta\theta$ identify the sector angle between the connection 7 of the leading edge to the hub and the periphery 8 of the leading edge.

As previously mentioned it is an advantage to design the leading edges 6 of the vanes swept backwards in order to make sure that pollutants slide towards the periphery instead of becoming stuck to the edges or being wound around the hub 4. At the same time however, the efficiency quite often decreases when the sweep angle is increased.

According to the invention the vane 5 is designed with its leading edge 6 being strongly swept backwards. This is defined as the angle difference $\Delta\theta$ in a cylinder coordinate system between the connection of the leading edge to the hub 4 and the periphery 8. According to the invention the difference shall be between 125 and 195 degrees, preferably 140 to 180 degrees. This is possible, without losing good efficiency, thanks to the fact that the leading edge 6 is located within the cylindric part 2 of the pump housing.

In order to make this location of the leading edge 6 possible, the impeller hub 4 is designed narrow. The diameter ratio between the connection 7 of the leading edge to the hub and the periphery 8 is only 0.1 to 0.4, preferably 0.15 to 0.35. This small ratio also has the advantage that the free throughlet through the impeller can be wide, thus making it possible for larger pollutants to pass.

According to a preferred embodiment of the invention, the connection 7 to the hub 4 of the leading edge 6 is located adjacent the end 12 of the hub, i.e. there is no protruding tip. This diminishes the risk of pollutants being wound around the central part of the impeller.

According to still another preferred embodiment of the invention, the leading edge 6 is located in a plane perpendicular to the impeller hub, i.e. where z is constant. This means that the sweep angle will be essentially constant, independent of the flow. As sewage pumps operate within a very broad field, this means that the pump impeller can be optimized independent of expected operation conditions.

I claim:

1. A pump impeller of a centrifugal or half axial type, the pump impeller used in a pump that pumps sewage water, the pump having a generally spiral formed pump housing (1) with a cylindric inlet (2), the pump impeller comprising:

a periphery defining a first diameter;

a hub (4) defining a second diameter; and at least one vane (5) having a backwards swept leading edge (6) with a first connection (7) to the hub (4) at the second diameter thereof and a second connection (8) to the periphery at the first diameter thereof, the leading edge (6) swept at a sector angle $\Delta\theta$ ranging between 125 degrees and 195 degrees as measured in a coordinate system with an origin in a center of the hub, the sector angle $\Delta\theta$ defined between the first connection (7) and the second connection (8).

2. A pump impeller according to claim 1, wherein the leading edge (6) of the at least one vane (5) lies in a plane perpendicular to the hub.

3. A pump impeller according to claim 1, wherein the connection (7) of the leading edge (6) to the hub (4) is located adjacent an end (12) of the hub.

4. A pump impeller according to claim 1, wherein the second diameter of the hub (4) and the first diameter of the periphery define a diameter ratio ranging between 0.1 and 0.4.

5. A pump impeller according to claim 1, wherein the second diameter of the hub (4) and the first diameter of the periphery define a diameter ratio ranging between 0.15 to 0.35.

6. A pump impeller according to claim 1, wherein the sector angle $\Delta\theta$ ranges between 140–180 degrees.

* * * * *